United States Patent [19]

Oda

[11] 4,455,722

[45] Jun. 26, 1984

[54] SLIDER FOR SLIDE FASTENER

[75] Inventor: Kiyoshi Oda, Namerikawa, Japan

[73] Assignee: Yoshida Kogyo K. K., Tokyo, Japan

[21] Appl. No.: 394,520

[22] Filed: Jul. 2, 1982

[30] Foreign Application Priority Data

Jul. 7, 1981 [JP] Japan ..... 56-105067

[51] Int. Cl.[3] ..... A44B 19/26

[52] U.S. Cl. ..... 24/427; 24/415

[58] Field of Search ..... 24/205.15 R, 205.15 E, 24/205 R.

[56] References Cited

U.S. PATENT DOCUMENTS

| | | | |
|---|---|---|---|
| 2,794,229 | 6/1957 | Mikulas | 24/205.15 R X |
| 3,822,443 | 7/1974 | Yoshida | 24/205.15 R |
| 3,925,857 | 12/1975 | Kihara | 24/205.15 R |
| 3,973,300 | 8/1976 | Takamatsu | 24/205.15 R |

FOREIGN PATENT DOCUMENTS

| | | | |
|---|---|---|---|
| 2543375 | 8/1976 | Fed. Rep. of Germany | 24/205.15 R |
| 48-35425 | 10/1973 | Japan . | |

*Primary Examiner*—William E. Lyddane
*Assistant Examiner*—Peter A. Aschenbrenner
*Attorney, Agent, or Firm*—Hill, Van Santen, Steadman & Simpson

[57] ABSTRACT

A slider for a slide fastener comprises a slider body including a pair of upper and lower wings defining therebetween a Y-shaped guide channel, the lower wing having on its interior surface a ridge extending longitudinally of the guide channel for being locatable between a pair of stringer tapes of the slide fastener to slidably engage fastener elements of the slide fastener. The lower wing also has in the interior surface a pair of furrows disposed one on each side of the ridge and extending parallel thereto for allowing fastener-element-supporting edge portions of the tapes to be displaced into the furrows respectively. The furrows thus reduce frictional resistance between the stringers and the interior surfaces of the slider body. With such slider it is possible to correct a longitudinal divergence in interengagement between the opposed stringers without breakage or other damage to fastener-element-holding threads.

10 Claims, 12 Drawing Figures

FIG. 11 PRIOR PROBLEM

SLIDER FOR SLIDE FASTENER

BACKGROUND OF THE INVENTION

1. Field of the Invention:

The present invention relates to a slider for a slide fastener.

2. Prior Art:

Japanese Patent Publication (Kokoku) No. 48-35425, issued Oct. 27, 1973, discloses a method of correcting a longitudinal divergence or deviation in interengagement between a pair of fastener stringers of a slide fastener, each stringer having a row of fastener elements in the form of resilient synthetic resin filament sewn to a tape along its inner longitudinal edge. In the method, one fastener stringer is threaded through a slider, and then the other fastener stringer is introduced into the slider. The slider is then moved forwardly to some extent along the opposed fastener element rows of the fastener stringers to interengage the same, thus providing a longitudinal divergence or deviation of interengagement between the fastener stringers. After that, the fastener stringers are pulled on their bottom ends laterally in opposite directions until such bottom end portions are disengaged all the way to the rear end of the slider. Thereafter, with the slider and one fastener stringer are held stationary, the other fastener stringer is forcibly moved lengthwise against the resilience of the fastener elements until the bottom ends of the opposed stringers are aligned with one another. Finally, the slider is forcibly moved backwardly almost all the way to the bottom ends of the stringers against the resilience of the fastener elements, and is then moved forwardly.

Known sliders for use in such divergence correction generally comprise a slider body including a pair of upper and lower wings each having a flat interior surface. However, with such prior slider, the stringers having the fastener elements are pressed against the flat interior surfaces of the slider body with great frictional resistance when one or both fastener stringers are forcibly moved through the slider against the resilience of the fastener elements, during which time the individual fastener elements are deformed. This great frictional resistance not only causes nonsmooth movement of the stringers through the slider, but also causes fastener-element-holding threads to be easily broken or otherwise damaged.

SUMMARY OF THE INVENTION

It is an object of the present invention to provide a slide fastener slider suitable for use in correcting a longitudinal divergence or deviation of interengagement between a pair of opposed fastener stringers.

Another object of the invention is to provide a slide fastener slider which enables the forcible movement of one or both fastener stringers through the slider with reduced frictional resistance between the interior surface of a lower slider wing and the fastener-element-supporting tape edges.

Still another object of the invention is to provide a slide fastener slider which can start its forced backward movement with reduced resistance.

According to the present invention, a slider for a slide fastener comprises a slider body including a pair of upper and lower wings defining therebetween a Y-shaped guide channel, the lower wing having on its interior surface a ridge extending centrally and longitudinally of the guide channel for being locatable between a pair of stringer tapes of a slide fastener to slidably engage fastener elements of the slide fastener. The lower slider wing has in the interior surface a pair of furrows or grooves disposed one on each side of the ridge and extending parallel thereto from near a slider neck to the rear end of the lower wing for allowing fastener-element-supporting edge portions of the tapes to be disposed into the furrows respectively. The furrows thus reduce frictional resistance between the stringers and the interior surfaces of the slider body.

Many other advantages, features and additional objects of the present invention will become manifest to those versed in the art upon making reference to the detailed description and the accompanying drawings in which two preferred embodiments incorporating the principles of the present invention are shown by way of illustrative example.

BRIEF DESCRIPTION OF THE DRAWINGS

FIG. 11, appearing with FIG. 4, is a fragmentary transverse cross-sectional view similar to FIG. 5, but illustrating a prior art problem.

DETAILED DESCRIPTION

Figure 1:
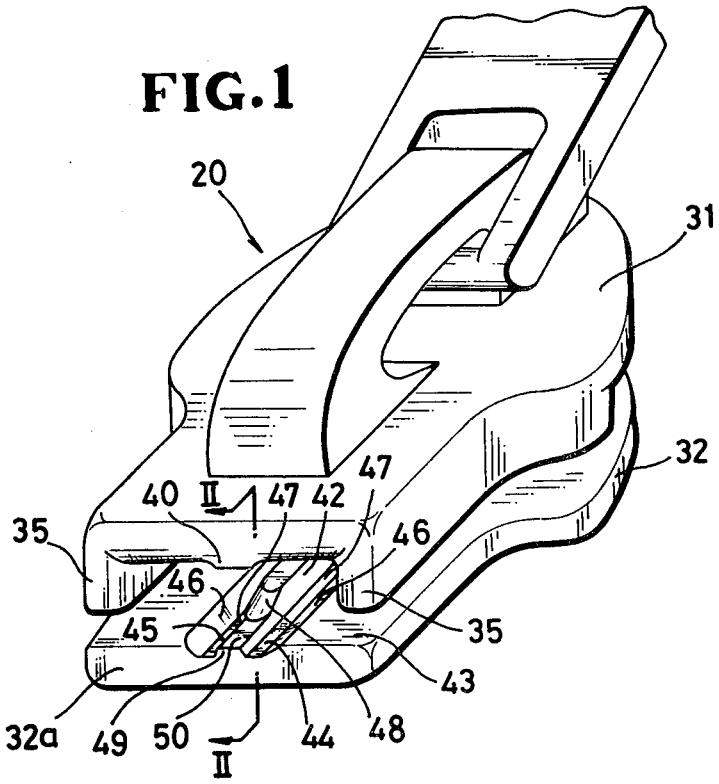
FIG. 1 is a fragmentary perspective view of a slider, for slide fasteners, according to the present invention.

The principles of the present invention are particularly useful when embodied in a slide fastener slider such as shown in FIG. 1, generally indicated by the numeral 20. The slider 20 is suitable for a slide fastener which comprises a pair of opposed stringers 21,22 (FIGS. 3 through 10) having a pair of rows of fastener elements 23,24 attached to a pair of tapes 25,26 along their respective inner longitudinal edges 25*a*,26*a* by means of sewing threads 27 (dash-and-dot lines in FIGS. 3 through 5). Each row of fastener elements 23,24 is a coiled or zigzag-shaped resilient filament made of synthetic resin; each individual fastener element has a coupling head 28 and a pair of upper and lower legs 29,30, as shown in FIG. 3.

Figure 3:
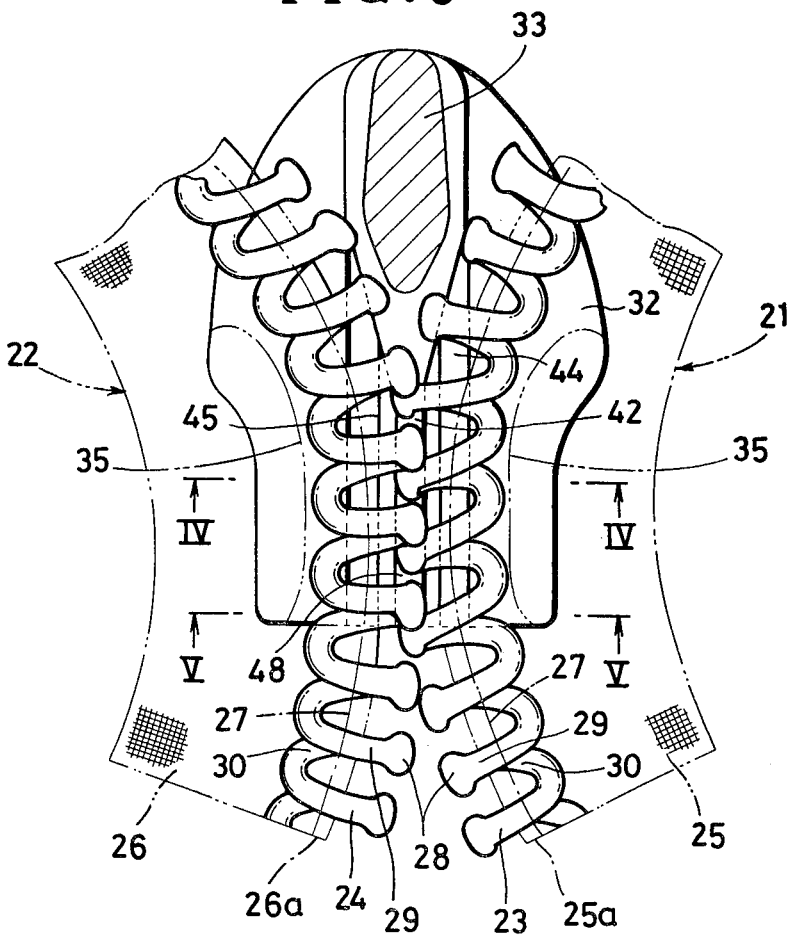
FIG. 3 is a plan view, partly in cross section, of the slider with an upper wing omitted, showing a pair of fastener stringers threaded through the slider.

As shown in FIGS. 1 and 3, the slider 20 comprises a slider body including a pair of parallel spaced upper and lower wings 31,32 joined at their front end by a neck 33 so as to define a Y-shaped guide channel 34 (FIGS. 4 and 5) between the wings 31,32 for the passage of the opposed fastener element rows 23,24 of the slide fastener. The upper wing 31 has a pair of flanges 35,35 projecting respectively from opposite lateral edges thereof toward and terminating short of the lower wing 32.

Figure 4:
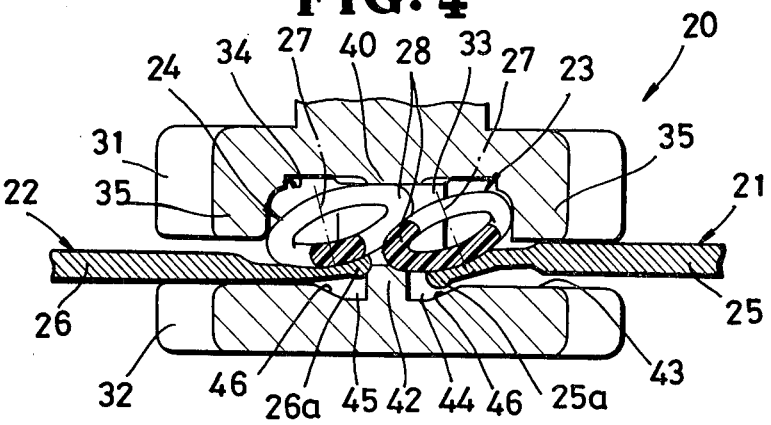
FIG. 4 is a fragmentary transverse cross-sectional view taken along line IV—IV of FIG. 3.
Figure 5:
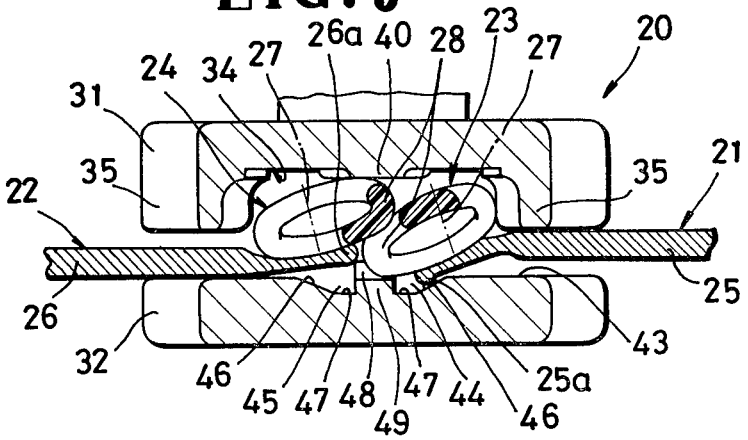
FIG. 5 is a fragmentary transverse cross-sectional view taken along line V—V of FIG.3.
Figure 5:
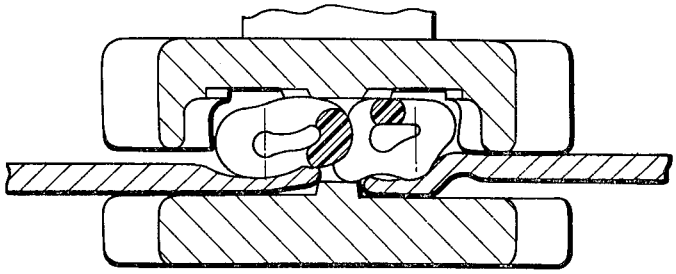

The upper wing 31 has a flat land 40 disposed centrally between the flanges 35,35 and extending longitudinally of the guide channel 34 and slidably engageable with the coupling heads 28 of the fastener elements 23,24 on their upper side, as shown in FIGS. 4 and 5. The lower wing 32 has a ridge 42 disposed opposite to the land 40 of the upper wing 31 and projecting from an interior surface 43 of the lower wing 32 for being locatable between the inner longitudinal edges 25a,26a of the tapes 25,26.

The lower wing 32 also has in its interior surface 43 a pair of furrows 44,45 disposed one on each side of the ridge 42 and extending parallel thereto from near the neck 33 to the rear end 32a of the lower wing 32. The furrows 44,45 allow the respective inner tape edge portions 25a,26a to be displaced into the furrows 44,45 respectively, thus reducing frictional resistance between the stringers 21,22 and the interior surfaces of the slider body during a correction of longitudinal divergence of deviation in interengagement between the opposed stringers 21,22 as described below. Each furrow 44,45 has an outer side surface 46 inclined at an obtuse angle with respect to a bottom surface 47 of the furrow, defining a corner of the same obtuse angle between the interior surface 43 of the lower wing 32 and the outer side surface 46 so that the inner longitudinal tape edge portions 25a,26a and the sewing threads 27 are prevented from being easily broken or otherwise damaged.

The ridge 42 extends from near the neck 33 toward and terminates slightly short of the rear end 32a of the lower wing 32. The ridge 42 has at its rear end a sloping surface 48 in order that the slider 20 can start its backward movement with reduced resistance. Such starting resistance of the slider 20 is further reduced by a shelf 49 disposed between the furrows 44,45 as an extension of the ridge 42 and having a top surface 50 flush with or slightly below the interior surface 43 of the lower wing 32. This is true because the shelf 49 supports the fastener elements 23(24) so as to keep the inner longitudinal tape edge 25a(26a) and the sewing threads 27 off the outer side surface 46 of the furrow, as shown in FIG. 5.

Figure 2A:
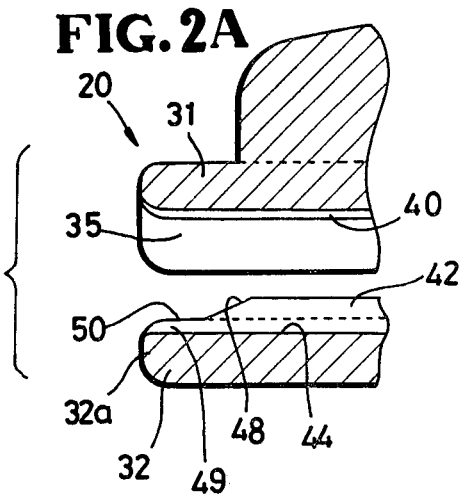
FIG. 2A is a fragmentary longitudinal cross-sectional view taken along line II—II of FIG. 1.
Figure 2B:
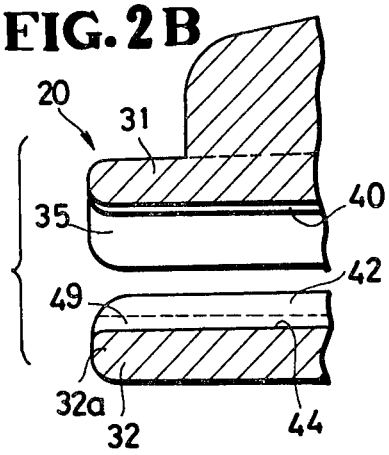
FIG. 2B is a fragmentary longitudinal cross-sectional view similar to FIG. 2A, but showing a modified form of the slider.

Alternatively, the ridge 42 may extend from near the neck 33 to the rear end 32a of the lower wing 42 and preferably has a rounded or chamfered rear end, as shown in FIG. 2B.

Figure 6:
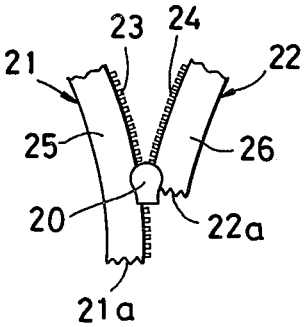
FIGS. 6 through 10 are fragmentary plan views of a slide fastener having the slider according to the present invention, illustrating the manner in which a longitudinal divergence in interengagement between a pair of fastener stringers is corrected.
Figure 7:
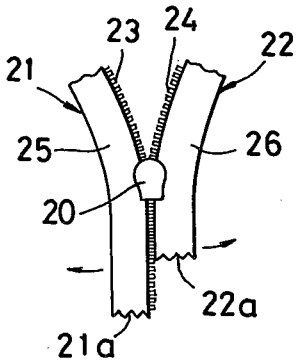
Figure 8:
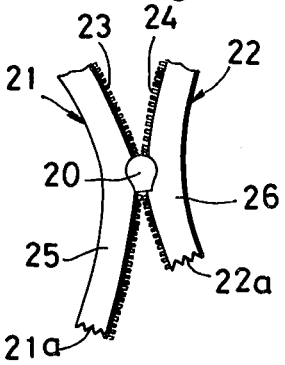

In use, one fastener stringer 21 is threaded through the slider 20, and then the other fastener stringer 22 is introduced into the slider 20 (FIG. 6). The slider 20 is then moved forwardly to some extent along the opposed fastener element rows 23,24 of the fastener stringers 21,22 to interengage the same, thus providing a longitudinal divergence or deviation in interengagement between the fastener stringers 21,22 (FIG. 7). After that, the bottom ends 21a,22a are pulled apart until such bottom end portions of the fastener stringers 21,22 are disengaged all the way to the rear end of the slider 20 (FIG. 8).

Figure 9:
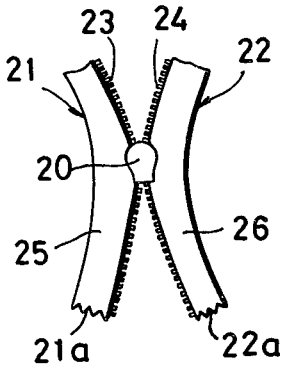
Figure 10:
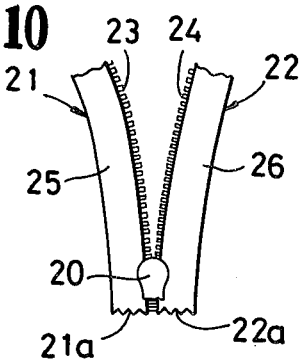

Thereafter, with the slider 20 and one fastener stringer 21 held stationary, the other fastener stringer 22 is forcibly moved lengthwise against the resilience of the fastener elements 23,24 until the bottom ends 21a,22a of the opposed stringers 21,22 are aligned with one another (FIG. 9). During that time, the inner longitudinal tape edge 25a of one stringer 21 is allowed to be displaced into the furrow 44 (FIG. 5), reducing frictional resistance between the stringers 21,22 and the interior surfaces of the slider body. Further, because of the inclined outer side surfaces 46 of the furrows 44,45, the inner longitudinal tape edge portions 25a,26a and the sewing threads 27 are not easily broken or otherwise damaged.

Then, the slider 20 is forcibly moved backwardly almost all the way to the bottom ends 21a,22a of the stringers 21,22 against the resilience of the fastener elements 23,24 (FIG. 5). At that time, since the ridge 42 has at its rear end the sloping surface 48, the slider 20 can start its backward movement with reduced resistance. Further, because the ridge 42 terminates short of the rear end 32a of the lower wing 32, such backward movement of the slider 20 is facilitated. Finally, the slider 20 is moved forwardly. The longitudinal divergence of the opposed fastener stringers 21,22 has thus been corrected.

With the slider 20, it is possible to correct the longitudinal divergence of the opposed stringers 21,22 easily without breakage or other damage to the inner longitudinal tape edge portions 25a,26a and to the sewing threads 27, thus providing an improved quality slide fastener.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A slider for a slide fastener having a pair of rows of continuous fastener elements mounted on a pair of tapes along their respective inner longitudinal edges, comprising:

(a) a slider body including a pair of parallel spaced upper and lower wings joined at their front end by a neck, there being defined a Y-shaped guide channel between said wings for the passage of the fastener element rows of the slide fastener;

(b) a ridge projecting centrally from an interior surface of said lower wing and extending longitudinally of said guide channel from near said neck toward a rear end of said lower wing, said ridge being locatable between the inner longitudinal edges of the tapes to slidably engage coupling heads of the fastener elements, said ridge terminating short of said rear end of said lower wing; and (c) said lower wing having in said interior surface a pair of furrows disposed one on each side of said ridge and extending parallel thereto from near said neck to said rear end of said lower wing for allowing the respective inner edge portions of the tapes to be displaced into said furrows respectively.

2. A slider according to claim 1, said ridge having at its rear end a sloping surface.

3. A slider according to claim 1, each of said furrows having an outer side surface inclined at an obtuse angle with respect to a bottom surface of each said furrow.

4. A slider according to claim 1, including a shelf disposed between said furrows as an extension of said ridge and having a top surface substantially flush with said interior surface of said lower wing.

5. A slider for a slide fastener having a pair of rows of continuous fastener elements mounted on a pair of tapes along their respective inner longitudinal edges, comprising:

(a) a slider body including a pair of parallel spaced upper and lower wings joined at their front end by a neck, there being defined a Y-shaped guide channel between said wings for the passage of the fastener element rows of the slide fastener;

(b) a ridge projecting centrally from an interior surface of said lower wing and extending longitudinally of said guide channel from near said neck toward a rear end of said lower wing, said ridge being locatable between the inner longitudinal edges of the tapes to slidably engage coupling heads of the fastener elements, said ridge having at its rear end a sloping surface; and (c) said lower wing having in said interior surface a pair of furrows disposed one on each side of said ridge and extending parallel thereto from near said neck to said rear end of said lower wing for allowing the respective inner edge portions of the tapes to be displaced into said furrows respectively.

6. A slider according to claim 5, each of said furrows having an outer side surface inclined at an aobtuse angle with respect to a bottom surface of the said furrow.

7. A slider for a slide fastener having a pair of rows of continuous fastener elements mounted on a pair of tapes along their respective inner longitudinal edges, comprising:

(a) a slider body including a pair of parallel spaced upper and lower wings joined at their front end by a neck, there being defined a Y-shaped guide channel between said wings for the passage of the fastener element rows of the slide fastener;

(b) a ridge projecting centrally from an interior surface of said lower wing and extending longitudinally of said guide channel from near said neck toward a rear end of said lower wing, said ridge being locatable between the inner longitudinal edges of the tapes to slidably engage coupling heads of the fastener elements, said ridge extending to said rear end of said lower wing, and said ridge having at its rear end a rounded sloping surface; and (c) said lower wing having in said interior surface a pair of furrows disposed one on each side of said ridge and extending parallel thereto from near said neck to said rear end of said lower wing for allowing the respective inner edge portions of the tapes to be displaced into said furrows respectively.

8. A slider according to claim 7, each of said furrows having an outer side surface inclined at an obtuse angle with respect to a bottom surface of each said furrow.

9. A slider for a slide fastener having a pair of rows of continuous fastener elements mounted on a pair of tapes along their respective inner longitudinal edges, comprising:

(a) a slider body including a pair of parallel spaced upper and lower wings joined at their front end by a neck, there being defined a Y-shaped guide channel between said wings for the passage of the fastener element rows of the slide fasteners;

(b) a single ridge disposed centrally on a planar interior surface of said lower wing and extending longitudinally of said guide channel from near said neck toward a rear end of said lower wing, said ridge being receivable between the inner longitudinal edges of the tapes and having a height enabling said ridge to directly slidably engage coupling heads of the fastener elements; and (c) said lower wing having in said interior planar surface, a single pair of furrows disposed one on each side of said ridge and extending parallel thereto from near said neck to said rear end of said lower wing for allowing the respective inner edge portions of the tapes to be displaced below said planar interior surface into said furrows respectively.

10. A slider according to claim 9, said ridge extending to the rear end of said planar interior surface.

* * * * *